US005737950A

United States Patent [19]

Yun-Bin

[11] Patent Number: 5,737,950

[45] Date of Patent: Apr. 14, 1998

[54] AMBIDEXTROUS VERTICAL INVERTED HANDED CAM LOCK

[75] Inventor: Hsu Yun-Bin, Taipai, Taiwan

[73] Assignee: Olympus Lock, Inc., Seattle, Wash.

[21] Appl. No.: 552,747

[22] Filed: Nov. 3, 1995

[51] Int. Cl.[6] ..... E05B 17/04

[52] U.S. Cl. ..... 70/379 R; 70/374; 70/462; 70/DIG. 62

[58] Field of Search ..... 70/379 R, 379 A, 70/380, 372, 374, 461, 462, DIG. 62

[56] References Cited

U.S. PATENT DOCUMENTS

| | | | |
|---|---|---|---|
| 470,413 | 3/1892 | Roche | 70/379 R |
| 1,278,553 | 9/1918 | Allmand | 70/379 R |
| 1,487,258 | 3/1924 | Menger et al. | 70/38 C |
| 1,564,463 | 12/1925 | Best | 70/379 R |
| 2,182,307 | 12/1939 | Behnke | 70/80 |
| 2,255,402 | 9/1941 | Vile | 70/380 |
| 2,580,026 | 12/1951 | Jacobi | 70/379 R |
| 2,804,765 | 9/1957 | Biblin | 70/372 |
| 2,852,926 | 9/1958 | Chervenka | 70/379 R |
| 3,102,412 | 9/1963 | Christopher | 70/379 R |
| 3,263,461 | 8/1966 | Tartaglia . | |
| 3,863,476 | 2/1975 | Patriquin . | |
| 4,099,397 | 7/1978 | Dauenaugh . | |
| 4,385,510 | 5/1983 | Harper | 70/364 R |
| 4,633,689 | 1/1987 | Wolniak et al. | 70/379 R |
| 5,038,589 | 8/1991 | Martin | 70/368 |
| 5,152,161 | 10/1992 | Lee | 70/127 |
| 5,265,453 | 11/1993 | Konii et al. | 70/379 R |

FOREIGN PATENT DOCUMENTS

| | | | |
|---|---|---|---|
| 45500 | 4/1977 | Japan | 70/380 |

*Primary Examiner*—Steven N. Meyers
*Assistant Examiner*—Donald J. Lecher
*Attorney, Agent, or Firm*—Richardson & Folise

[57] ABSTRACT

An ambidextrous vertical inverted handed cam lock for cabinet doors and drawers has a conventional pin tumbler cylinder and plug assembly. An arcuately movable bolt is journaled for rotation about a rearwardly extending portion of the plug. A conventional lazy cam drives the bolt. An arcuately repositionable bolt rotation limiter provides either left hand or right hand throws for the bolt while simultaneously allowing for inverted vertical use.

4 Claims, 2 Drawing Sheets

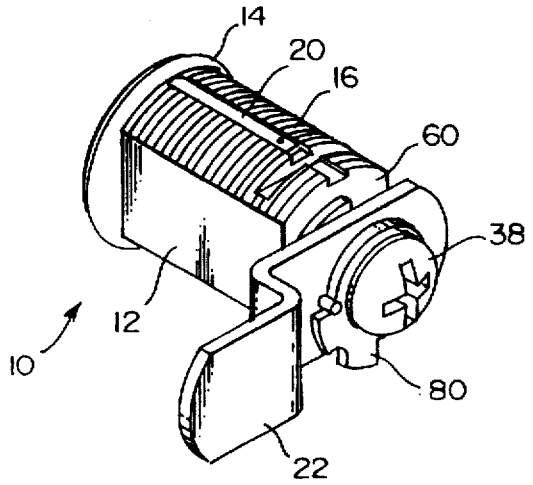
FIG. 1
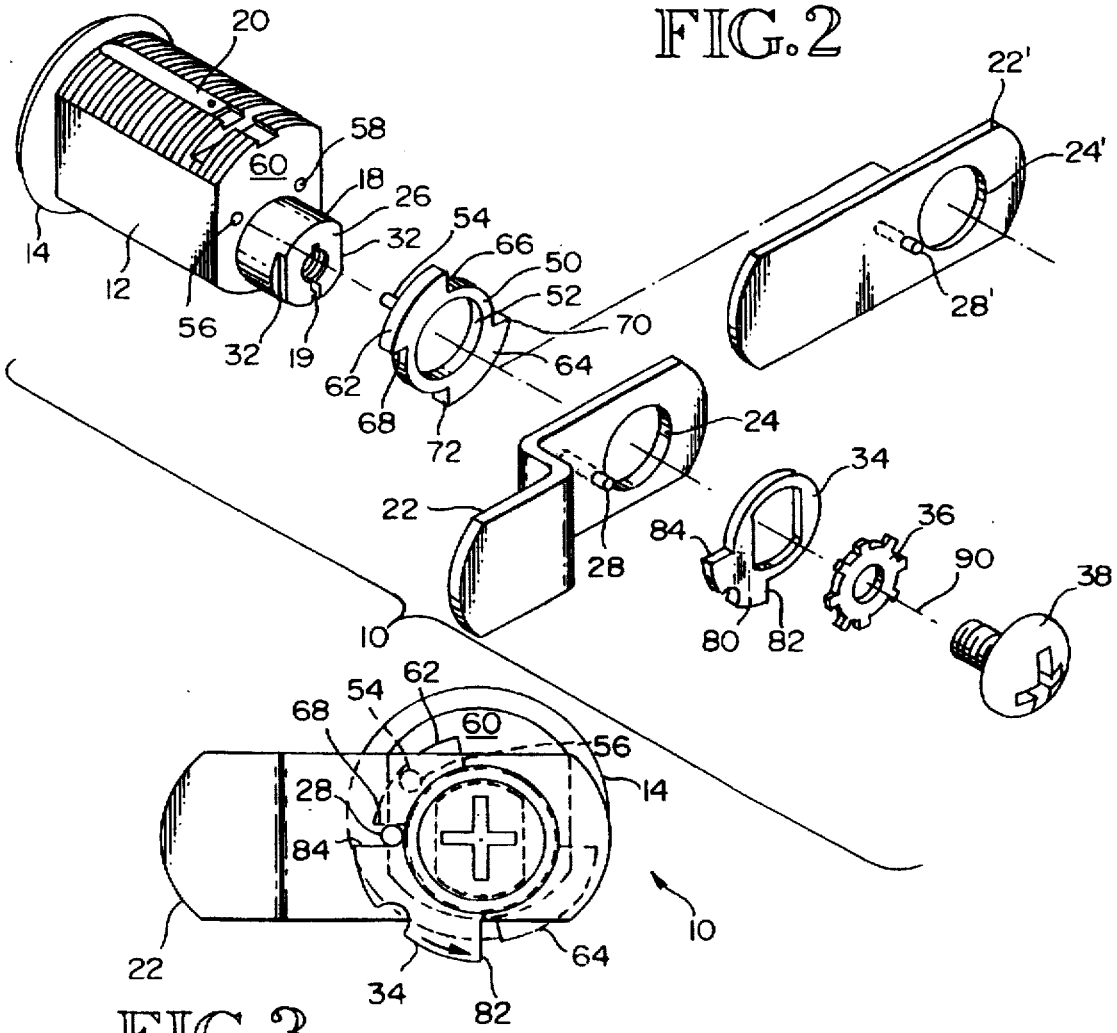
FIG. 2
FIG. 3

FIG. 4
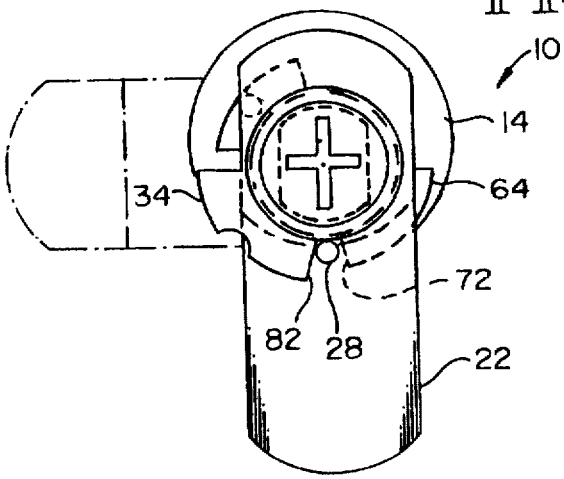
FIG. 5
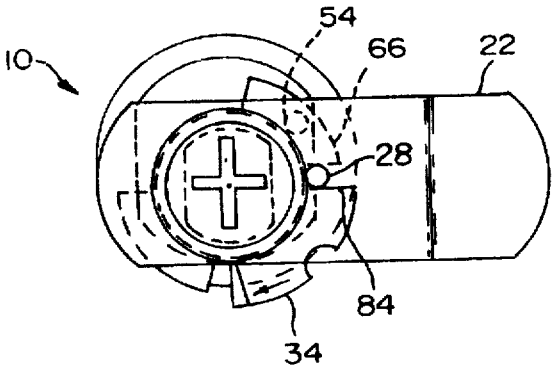
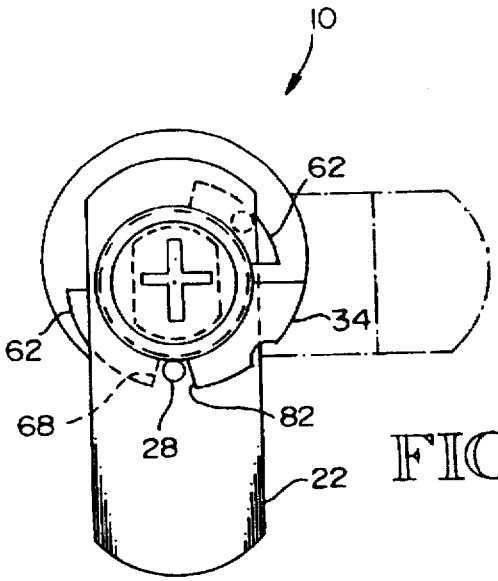
FIG. 6
FIG. 7
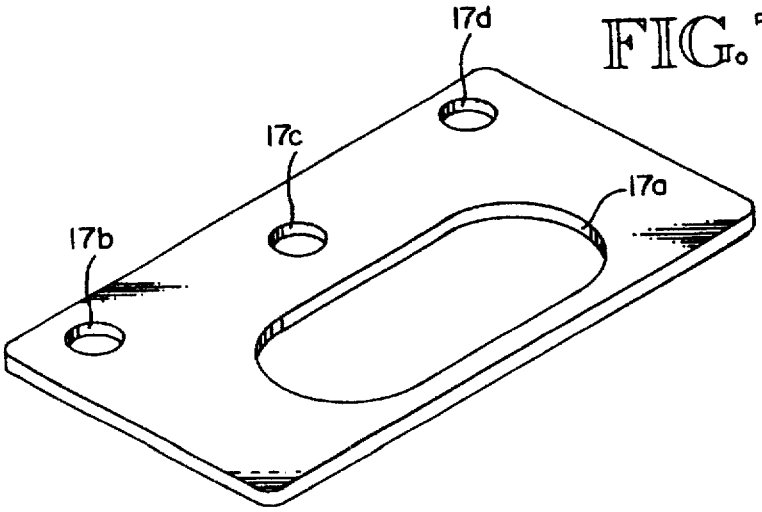

AMBIDEXTROUS VERTICAL INVERTED HANDED CAM LOCK

TECHNICAL FIELD

Invention relates to security devices for cabinet drawers and doors. More specifically, the invention relates to pin tumbler cam locks.

BACKGROUND OF THE ART

There are two basic families of cabinet drawer and door locks: deadlocking and latch locking type locks; and, cam type locks. Both families of locks are used on cabinet drawers and doors such as those found on office desks, credenzas and interior cabinetry. In the former family, an elongated bolt moves in a reciprocating manner into and out of locked and unlocked positions, respectively upon actuation of a key. In the latter family, an elongated bolt moves along an arcuate path, between locked and unlocked positions. In the cam family of locks, an angular rotation of 90° is typically sufficient to determine the locked and unlocked positions.

Both families of locks may have their bolts actuated by either pin tumbler cylinder and plug assemblies, or disk tumbler type assemblies. The disk tumbler type assemblies are the least expensive and historically have been used in the cam type of lock. A lock of this type is shown in U.S. Pat. No. 3,863,476 to Patriquin in which a plurality of spring loaded plates in a plug are biased to position a protrusion from the plates into an elongated trough or cavity in an externally threaded lock body. Interference between the protrusions and sidewalls of the lock body trough prevent rotation of the plug. Upon insertion of a key into a key way of the plug, the plates retract and the protrusions are withdrawn from the trough. Thereupon, the plug can rotate within the threaded lock body. The plug is longitudinally restrained within the lock body by a spring loaded clip. The bolt is typically journaled for rotation with and screwed on a longitudinal extension at the rear of the plug. A cam lock of this type is considered a "direct drive" cam lock because the bolt is directly journaled for rotation with the plug. Stated another way, consider a cam lock of the type described in which the lock is received in a desk drawer wherein the bolt at a 12 o'clock position interferes with a downwardly protruding sill or ledge in the desk. By inserting a key into the plug key way the disk tumblers are retracted so as to be free of a trough in the externally threaded cylindrical body. Rotation of the key by 90° to the 3 o'clock position clears the bolt of the desk so that the drawer may be opened. The externally threaded, cylindrical lock body may be provided with a pair of internal troughs angularly spaced at 90° with respect from one another so that the key may be withdrawn while the bolt is in the unlocked, 3 o'clock position. Otherwise, to remove the key, the plug must be counter-rotated back into the 12 o'clock position leaving the bolt in the "locked position" while the drawer is still open. This procedure has the undesirable consequence in that accidentally closing the open desk drawer with the bolt locked into the 12 o'clock position tends to mar the desk cabinetry. By positioning a second trough in the lock body cavity at the 3 o'clock position, this result can be avoided.

Over the years, it has become desirable to provide cam locks with a pin tumbler rather than a disk tumbler system. In the pin tumbler system, the disk plates are replaced with a series of cylindrical pins which reside in bores in the plug. These "bottom pins" have differing lengths corresponding to protrusions and valleys in a mating key. The lock body or cylinder is provided with a corresponding series of spring loaded top pins which can drop down into the bores in the plug into which the lower pins reside. When a key is inserted into the plug key way, the top pins and bottom pins form a shear line at the interface of the plug and cylinder allowing the plug to rotate freely. A particular problem with this type of lock is that the key can only be inserted or removed when the top and bottom pins are in alignment (typically the 12 o'clock position). Thus, a cam lock adapted as a pin tumbler lock will suffer from the "damaged desk" syndrome discussed above unless a means is provided for rotating and locking the bolt in respective 12 o'clock and 3 o'clock positions while permitting continued rotation of the key back to the 12 o'clock position.

For this purpose, the so called "lazy cam" has been developed in which the bolt of a pin tumbler type cam lock is free to rotate about a protrusion extending from a rearward surface of the plug. The lazy cam however is journaled for rotation with the plug and drives a pin or other protrusion on the bolt. An opposite side of the bolt is typically also provided with a forwardly extending pin which cooperates with laterally extending shoulders on the rear of the cylinder so as to limit rotation of the bolt through 90°. The above-described structure permits the plug to rotate through 360° while the bolt only rotates through 90° thus allowing the key to be removed while the bolt remains rotationally contained between the shoulder on the cylinder and a shoulder on the lazy cam. The desk drawer can now be opened and closed with the bolt in the unlocked position with the key removed.

The above-described lazy cam design provides the cam lock with all of the advantages of a pin tumbler design (e.g. ease in re keying, possible master keying with other cabinet drawer and door locks as well as entry way locks) which are difficult to achieve or unattainable with disk tumbler type locks. However, geometric realities prevent the bolt from being positionable anywhere other than the 12 o'clock and 3 o'clock positions described without changing the threaded cylinder body so as to reposition the shoulders thereon which define the arcuate range of movement for the bolt. Alternate positioning for the bolt is desirable as consumers have needs for cam locks having bolts which operate between the 12 o'clock and 3 o'clock positions; the 3 o'clock and 6 o'clock positions; the 6 o'clock and 9 o'clock positions; and, the 9 o'clock and 12 o'clock positions as in drawer locks; left hand door locks; tray locks; and, right hand door locks respectively.

U.S. Pat. No. 4,099,397 to Dauenbaugh in part addresses this problem by providing a cam type lock which will accept either a complete disk tumbler lock, or a complete pin tumbler lock for driving an arcuately moveable bolt. The bolt defines a square aperture therein which can be positioned in either the 12 o'clock, 3 o'clock, 6 o'clock, or 9 o'clock positions on a square protrusion from a driver attached to the back of either the pin tumbler or disk tumbler lock assembly. Dauenbaugh, however, requires the use of a master lock body, separate from the pin tumbler or disk tumbler locks to house the locks, drivers, bolts, etc. undesirably increasing the cost of the cam lock.

A need therefore exists for a low cost, pin tumbler cam lock providing ambidextrous positions for an arcuately moveable bolt.

SUMMARY OF THE INVENTION

It is therefore an object of the present invention to provide a pin tumbler, lazy cam type cam lock having an ambidextrous, arcuately moveable bolt.

The invention achieves this object, and other objects and advantages which will become apparent from the description which follows by providing a pin tumbler cam lock having a cylindrical plug and an elongated cylinder defining a longitudinal bore for rotatably receiving the plug. A lazy cam is journaled for rotation with the plug while a selectively positionable bolt rotation limiter can be mounted in one of at least two positions to limit angular motion of a bolt through two different 90° arcuate paths.

In a preferred embodiment of the invention, the bolt rotation limiter has a pin extending therefrom which is received in one of two bores in the lock cylinder. Two pairs of shoulders are defined on the bolt rotation limiter by two diametrically opposed, radially extending arcuate portions. These portions form shoulders which selectively limit the arcuate travel of the bolt.

BRIEF DESCRIPTION OF THE DRAWINGS

FIG. 1 is an isometric, environmental rear view of a cam lock employing the general principals of the invention.

FIG. 2 is an exploded, isometric view similar to FIG. 1.

FIG. 3 is a rear view of a lock configured for use with a right hand cabinet door wherein the bolt rotation limiter is in a first position corresponding to a latched position of the bolt.

FIG. 4 is a rear view, similar to FIG. 3 in which the bolt is rotated a 90° to an unlocked position.

FIG. 5 is a rear view of the lock in a locked position in which the bolt rotation limiter has been repositioned to a second position suitable for use with a left hand cabinet door.

FIG. 6 is a rear view, similar to FIG. 5 with the bolt moved to an unlocked position.

FIG. 7 is an isometric environmental view of a retaining plate for use with the cam lock.

DETAILED DESCRIPTION OF THE PREFERRED EMBODIMENTS

An ambidextrous vertical inverted handed cam lock for cabinet doors and drawers, in accordance with the principals of the present invention is generally indicated at reference numeral 10 in the figures. The lock is of the pin tumbler type and is an improvement upon the re keyable cam lock shown and described in U.S. Pat. No. 5,038,589 issued to Martin on Aug. 13, 1991 the disclosure of which is incorporated herein by reference.

It is sufficient for the purposes of this disclosure to state that the lock 10 has a cylinder 12 having flat side walls for receipt in a bore in a cabinet door or drawer along with a radially extending rim 14 which in cooperation with a threaded nut (not shown) for engagement with threads 16 secures the lock 10 in the cabinet door or drawer. A plate shown in FIG. 7 has a conventional main aperture 17(*a*) for receiving the cylinder 12 and preventing rotation of the same when the plate is secured to adjacent cabinetry. Three holes, 17(*b*), (*c*) and (*d*) are provided for receipt of an appropriate wood screw. By placing a screw in hole 17(*c*), rotation of the nut (not shown) can be prevented.

The cylinder 12 has a longitudinal bore for receipt of a plug 18 having a key way 19 in communication with a plurality of bores for receiving bottom pins. As is well known to those of ordinary skills in the art, the cylinder 12 has a plurality of corresponding bores for receiving spring biased top pins which when the plug 18 is in place as shown in FIG. 2 are further secured by a slide 20. The lock further comprises an arcuately moveable bolt 22 which defines an aperture 24 permitting the bolt to freely rotate on a rearwardly extending portion 26 of the plug 18. The bolt may be of the off set type 22 as shown, or a straight bolt 22' as will be understood by those of ordinary skill in the art. The bolt also has a transverse pin 28 with rearwardly and forwardly extending portions whose purposes will be discussed further herein below.

The rearwardly extending portion 26 of plug 18 is also provided with a laterally disposed flats 32 which journal a conventional lazy cam 34 for rotation with the plug 18. The lazy cam is longitudinally secured to the plug 18 by a conventional boar star washer 36 and screw 38. Interpositioned between the bolt 22 and cylinder 12 is a bolt rotation limiter 50 having a circular inner sidewall 52 sized for receipt about the rearwardly extending portion 26 of the plug 18. The bolt rotation limiter 50 would be free to rotate about the rearwardly extending portion were it not for the presence of a longitudinally directed pin 54 which is fixed to a forwardly directed surface of the bolt rotation limiter 50. The pin 54 is adapted for receipt in either of a left hand longitudinal bore 56 or a right hand longitudinal bore 58 in a rearward surface 60 of the lock cylinder 12. When seated in the appropriate bore 56, 58, radially extending, arcuate protrusions 62, 64, on the bolt rotation limiter define four shoulders 66, 68, 70, and 72 which engage the forwardly extending portion of the pin 28 of the bolt 22. These shoulders act in pairs to limit the arcuate movement of said bolt to not more than approximately 90°. The cam mechanism 34 also has a conventional radially extending, arcuate protrusion defining shoulders 82, 84 which engage the rearwardly extending portion of pin 28 of bolt 22 such that rotation of the plug 18, rotates the lazy cam 34 thereby driving the bolt 22 in an arcuate path about a longitudinal axis 90. The lazy cam 34 permits the plug to rotate through 360° permitting a key (not shown) to be inserted and removed from the plug 18. By subtending an angle of approximately only 90° with respect to the longitudinal axis 90, the shoulders cause 360° rotation of the plug to translate the bolt only through 90°. The radially extending protrusion 62, 64 on the bolt rotation limiter 50 are diametrically opposed and also subtend to angles of approximately 90°. Thus, the rotational distance between opposite shoulders 66,70 or 68,72 is also 90° limiting rotation of the bolt 22 to 90° as well.

By repositioning the bolt rotation limiter 50 from engagement of its pin 54 with bore 56, to bore 58, the vertical orientation of the cylinder 12 and plug 18 can be advantageously maintained while the throw of the bolt 22 is translated through a full 90°. In this way, the lock 10 can ben used as either a left hand door lock, or a right hand door lock as will be seen with respect to FIGS. 3–6. Removal, reorientation and reinsertion of the lazy cam is also necessary to achieve the desired reconfiguration. That is, after the bolt rotation limiter 50 has been repositioned and the cam 34 has been removed from the plug 18, the cam must be rotated through 180° about a line defined by the plane of the lazy cam. Further understanding may be made by reference to FIGS. 3–6.

As shown in FIG. 3, the lock 10 is shown in rear view with the bolt 22 in a locked, right handed position (i.e. the 3 o'clock position) if viewed from the front. The forwardly extending portion of the pin 28 of bolt 22 is trapped between the shoulder 84 of the lazy cam 34 and the shoulder 68 of the bolt rotation limiter 50. By inserting the key and rotating the key, plug and lazy cam through a full 360°, the bolt 22 will assume the unlocked position shown in FIG. 4 while the pin 28 is trapped between the shoulder 82 of the lazy cam 34 and the shoulder 72 of the bolt rotation limiter 50.

To reconfigure the cam lock 10 from a right hand cabinet door lock as shown in FIGS. 3 and 4, to a left hand cabinet door lock as shown in FIGS. 5 and 6 the bolt rotation limiter 50 is repositioned so that its longitudinally directed pin 54 is received in the right hand longitudinal bore 58 in the rear surface 60 of the cylinder 12. The lazy cam 34 has been rotated through 180° about a line defined by the plane of the figure. The bolt 22 is now in the locked 9 o'clock position (as viewed from the front) while the bolt pin 28 is trapped between the shoulder 84 of the lazy cam 34 and the shoulder 66 of the bolt rotation limiter 50. Rotation of the key (not shown) through 360° will position the bolt in the unlocked position shown in FIG. 6 with the bolt pin 28 trapped between shoulder 82 of the lazy cam 34 and shoulder 68 of the bolt rotation limiter 50.

In all of the positions shown in FIGS. 3–6, the key way 19 is in the vertical position with respect to the cylinder 12 thereby locking the plug 18 (and therefore the bolt 22) in the positions shown in solid lines. In either case, the key (not shown) may be removed from the plug.

The above disclosure describes an ambidextrous cam lock which can be used for left hand or right hand cabinet door applications. As will be apparent to those of ordinary skill in the art upon reviewing the above disclosure, the lock 10 may be modified for desk drawer or tray applications by repositioning the bolt 22 without repositioning the lazy cam 34 so that the pin 28 has its forwardly directed portion captured between the shoulders 66, 70. In this manner, the key way 19 remains in the advantageous vertical position. Other modifications and variations of the invention within the ability of those of ordinary skills and are also contemplated. Therefore, the invention is not to be limited by the above disclosure, but is to be determined as scope by the claims which follow.

I claim:

1. An ambidextrous cam lock for cabinet doors and drawers, comprising:

a cylindrical plug defining front and rear ends and having a longitudinally directed keyway and a plurality of radially directed pin tumblers in communication with the keyway;

an elongated cylinder having a plurality of radially directed, spring loaded top pins and an off-center, longitudinal bore therein for rotatably receiving the plug;

a lazy cam journaled for rotation with the plug;

a selectively positionable bolt rotation limiter having a forwardly projecting pin on the bolt rotation limiter for receipt in two bores angularly displaced on the rear end of the cylinder for selectively mounting the bolt rotation limiter adjacent to the rear end of the cylinder in a plurality of angular positions; and, an angularly moveable bolt journaled for rotational movement about the plug, the bolt having a first structure thereon for engagement with the lazy cam and a second structure thereon for engagement with the bolt rotation limiter, wherein the first and second structures are forwardly and rearwardly projecting pins positioned so that the lazy cam drives the bolt and the bolt rotation limiter limits the angular travel of the bolt.

2. The cam lock of claim 1, wherein the bolt rotation limiter defines a centrally located aperture for passage therethrough of a rearwardly extending portion of the plug, and wherein the bolt rotation limiter also has two diametrically opposed radially extending arcuate portions defining shoulders for limiting the arcuate travel of the bolt.

3. An ambidextrous cam pin tumbler lock for cabinet doors and drawers, comprising:

a cylindrical plug having a longitudinally directed keyway;

an elongated cylinder having a longitudinal bore therein for rotatably receiving the plug;

a lazy cam journaled for rotation with the plug;

a selectively positionable bolt rotation limiter having a forwardly projecting pin on the bolt rotation limiter for receipt in two bores angularly displaced on the cylinder for selectively mounting the bolt rotation limiter to the cylinder in any one of a plurality of angular positions; and, an angularly moveable bolt rotationally mounted about the plug, the bolt having a first structure thereon for engagement with the lazy cam and a second structure thereon for engagement with the bolt rotation limiter, wherein the first and second structures are forwardly and rearwardly projecting pins positioned so that the lazy cam drives the bolt and the bolt rotation limiter limits the angular travel of the bolt.

4. The cam lock of claim 3, wherein the bolt rotation limiter defines a centrally located aperture for passage therethrough of a rearwardly extending portion of the plug, and wherein the bolt rotation limiter also has two diametrically opposed radially extending arcuate portions defining shoulders for limiting the arcuate travel of the bolt.

* * * * *